US012774555B2

(12) United States Patent
Aydin et al.

(10) Patent No.: US 12,774,555 B2
(45) Date of Patent: Oct. 27, 2026

(54) SYSTEM AND A METHOD FOR PROCESSING TEXTILES

(71) Applicant: JEANOLOGIA, S.L., Paterna (ES)

(72) Inventors: Hüseyin Aydin, Çiğli/Izmir (TR); Vicente Albert Revert, Paterna (ES); Merih Ozcelik, Çiğli/Izmir (TR)

(73) Assignee: JEANOLOGIA, S.L., Paterna (ES)

( * ) Notice: Subject to any disclaimer, the term of this patent is extended or adjusted under 35 U.S.C. 154(b) by 853 days.

(21) Appl. No.: 18/171,815

(22) Filed: Feb. 21, 2023

(65) Prior Publication Data

US 2023/0228031 A1 Jul. 20, 2023

(30) Foreign Application Priority Data

Jan. 19, 2022 (TR) ..... 2022/000633

(51) Int. Cl.

| | |
|---|---|
| ***D06M 11/34*** | (2006.01) |
| ***D06F 35/00*** | (2006.01) |
| ***D06F 43/00*** | (2006.01) |
| ***D06L 4/50*** | (2017.01) |

(52) U.S. Cl.
CPC ..... *D06M 11/34* (2013.01); *D06F 35/001* (2013.01); *D06F 43/007* (2013.01); *D06L 4/50* (2017.01)

(58) Field of Classification Search
CPC ..... D06M 11/34; D06L 4/50; D06F 35/001; D06F 43/007
See application file for complete search history.

(56) References Cited

U.S. PATENT DOCUMENTS

2023/0181779 A1* 6/2023 Golkowski ..... A61L 2/14 422/28

FOREIGN PATENT DOCUMENTS

| | | | | |
|---|---|---|---|---|
| EP | 3670737 A1 | | 6/2020 | |
| JP | 2000233099 | * | 8/2000 | |
| WO | WO-2017218832 A1 | * | 12/2017 | ..... A61P 31/04 |

OTHER PUBLICATIONS https://www.jeanologia.com/g2-evo/ (Year: 2026).*
Superiority of Sustainable Ozone Wash Over Conventional Denim Washing Technique (Year: 2021).*

* cited by examiner

*Primary Examiner* — Joseph L. Perrin
(74) *Attorney, Agent, or Firm* — Maier & Maier, PLLC

(57) ABSTRACT

A system including: a machine for processing textiles and configured to treat, within the same, textiles with a gaseous mixture including ozone gas; and a dehumidification system connected to, or integrated into, the machine and configured to reduce a humidity of the gaseous mixture. Also, a method for processing textiles, including: in a machine for processing textiles, treating textiles with a gaseous mixture that includes ozone gas; and, using a dehumidification system connected to, or integrated into, the machine for reducing a humidity of the gaseous mixture.

14 Claims, 3 Drawing Sheets

SYSTEM AND A METHOD FOR PROCESSING TEXTILES

TECHNICAL FIELD

The present disclosure concerns a system for processing textiles with ozone gas, and a related method. The present disclosure also concerns the textiles that are processed, i.e. treated, using the aforementioned system or method. In a non-limiting example, the textiles are garments.

BACKGROUND

Treating textiles, such as garments, with ozone gas is known. Patent document EP3670737A1 describes processing wool garments with ozone gas in a tumbler for inhibiting the garments' subsequent felting and shrinkage, and it also describes that said garments are wetted to a particular water to garment concentration by weight. More generally, the treatment of the textiles with ozone gas can be used for achieving a number of different finishing effects on the textiles, such as for example bleaching (i.e. changing the color of) the textile's fabric. In the art of treating textiles with ozone gas, an important objective is avoiding the creation of unwanted defects, such as color inhomogeneities, on the textile's surface during the ozone treatment. Moreover, another main objective is to increase the production capacity of the used systems and methods e.g. increase the amount of garments that a system (i.e. machine, apparatus) can process per batch. It is particularly challenging to simultaneously achieve the aforementioned two objectives because when attempting to increase the production capacity using what is previously known in the art, e.g. by placing a large batch of garments in a drum of an apparatus for processing textiles with ozone, then the ozone treatment may cause the creation of color inhomogeneities on the garments. These inhomogeneities may not appear if the same apparatus is used for treating a smaller batch. Hence, there are needed systems and a methods for controllably treating textiles with ozone, and which allow for treating large batches of textiles while avoiding the creation of defects on the garments.

SUMMARY

The present invention allows for controllably treating textiles with ozone while avoiding or preventing the creation of defects, such as color inhomogeneities (e.g. stains), on the surface of the textiles. Importantly, the present invention allows avoiding said defects regardless of whether the batch of the treated textiles comprises a few or a lot of textiles. The present invention works particularly well for providing efficiently and with a high degree of reproducibility various different finishing effects on the textiles, and in particular for providing a balanced and homogenous bleaching of textiles, preventing the textile's undesired staining and uneven color distribution during the bleaching process. The optimized and high-quality processing that is provided with the present invention, can advantageously permit reducing the time, chemicals, energy and costs related to processing the textiles.

The present invention in its first aspect concerns a system for processing textiles, the system comprising: a machine for processing textiles (i.e. a textile processing machine), said machine being configured to treat, within the same, textiles with a gaseous mixture comprising ozone gas; and a dehumidification system which is connected to or is integrated into (or with) the textile processing machine. The dehumidification system is configured to reduce a humidity of the gaseous mixture. By reducing the humidity of the gaseous mixture, the dehumidification system can in effect control the humidity of the gaseous mixture. Surprisingly, the use of said dehumidification system for reducing or controlling the humidity of the gaseous mixture with which the textiles are treated, can achieve avoiding the creation of defects on the textiles, even when the apparatus processes a lot of said textiles per batch. The gaseous mixture can comprise a variety of different gases such as oxygen or nitrogen, but in a simple yet preferred embodiment, said mixture comprises atmospheric air mixed with ozone gas. Such a gaseous mixture can for example be created when in a part of the textile processing machine which originally contains the textiles and normal atmospheric air, there is introduced ozone which becomes mixed with said air. The gaseous mixture may also comprise water vapors which are released from the textiles before or during the textile's processing with ozone. The system of the first aspect of the invention, may be a machine or an apparatus for treating the textiles.

For the purpose of attempting explaining the beneficial effect that the use of the aforementioned dehumidification system has on the treatment of the textiles when using the system of the first aspect of the invention, the inventors propose the following which should not be perceived as limiting in any way the scope of the herein claimed invention. The inventors propose that the use of the humification system may in effect prevent or inhibit the formation of droplets of water on the surface of the textiles or on parts of the system in which the textiles are treated. It is proposed that when said droplets are possibly formed and absorbed by, or simply contact, the textiles, they may change locally the humidity of the textile's surface, which may in turn change locally the reactivity of said surface with the ozone, and may lead to the formation of local defects. It is further proposed, that said droplets may be more easily formed when increasing the amount of the textiles being treated with ozone in a given physical space/volume, because often a typical byproduct of the reaction of ozone with textiles is water, and said water (water molecules) may act to increase the humidity of the gaseous atmosphere during the treatment process. Hence, the inventors contemplate that when treating a large batch of textiles, a relatively large amount of water and corresponding humidity may be released from the textiles, or may be produced by the reaction of the textiles' surface with the ozone gas, and hence, the use of the dehumidification system may advantageously act for eventually reducing the humidity of the gaseous atmosphere, keeping said humidity under control. Likewise, the inventors do not dismiss the possibility that the humidity of the gaseous mixture which contains the ozone may directly affect the reactivity of the ozone with different parts of the textiles' surface, or that said humidity may cause the formation of droplets of water on different points of the surface of the textiles. Therefore, it is contemplated that the use of the aforementioned dehumidification system for reducing the humidity of the gaseous mixture, may prevent or inhibit the formation of droplets of water on or close to the textiles, and/or may act for controlling the reactivity of the textiles with the ozone, for the purpose of preventing or inhibiting the creation of defects on the surface of the garments, even for large batches of garments.

In some embodiments of the first aspect of the invention, the dehumidification system comprises any of a dehumidifier compressor, a condenser, a desiccant dehumidifier, a membrane-based dehumidifier, or a combination thereof. Said dehumidification system may also be called dehumidification module.

In a preferred embodiment of a system according to the first aspect of the invention, the textile processing machine (i.e. the machine for processing textiles) further comprises a chamber and a drum in the chamber, and said drum is configured to receive the textiles to be processed by the system. There are known types of textile processing machines for industrial, and even for domestic use, which comprises chambers within which there are tumblers or drums for processing textiles. Some preferred embodiments of the machine or system according to the invention may externally look similar to said known systems, and/or may have similar types of a chamber and a drum. The skilled person may understand that said tumbler is preferably rotatable and used for tumbling the textiles or, more generally, for imparting a mechanical action on the textiles. The skilled person may also understand that the gas mixture containing the ozone, may be the gas mixture found in said chamber or more specifically found in said drum during the treatment of the textiles.

In a preferred embodiment, the textile processing machine according to the first aspect of the invention further comprises an ozone generator configured to produce and provide the ozone gas. Said generator may be part of the textile processing machine, or may be a separate module that is connected to the textile processing machine for providing to the latter the ozone gas or the gaseous mixture containing the ozone gas. There are known types of ozone gas generators for use by the textile industry, and typically generators of this type produce ozone from the oxygen of the atmosphere.

In a preferred embodiment according to the first aspect of the invention, the dehumidification system comprises a closed-circuit cooler configured to cool a zone via which the gaseous mixture passes in the dehumidification system, such that dew is produced in said zone. Hence, the operation of said closed-circuit cooler in the particular type of dehumidification system that has it, can result to the reduction of the moisture in the gaseous mixture passing though the dehumidification system. Said zone may be a tube, i.e. a conduit or gas line, via which the gaseous mixture passes. Moisture from the gaseous mixture may be condensed in said zone, and may preferably be collected or removed therefrom. Advantageously, dehumidification systems which comprise such a closed-circuit cooler are commercially available and particularly easy to integrate and use with the rest of the system.

Optionally and preferably, the dehumidification system comprises a condenser and a water discharge line. Said water discharge line comprises a discharge outlet and a gas anti-leakage system configured to discharge via the same liquid water (dew) formed at the condenser when the system is in operation. The aforementioned optional gas anti-leakage system is configured to prevent the escape of ozone to the environment via the water discharge line, when the system is in operation. More preferably the gas anti-leakage system comprises a syphon and/or two water discharge valves which are sequentially located along the water discharge line. The use of the aforementioned water discharge line can advantageously permit the continuous operation of the dehumidification system over prolonged periods of time during which a high volume of dew may be produced. Moreover, the gas anti-leakage system may advantageously contribute to the safeness of the system, because ozone is toxic and hence its leakage via the optional water discharge line preferably should be avoided.

In a preferred embodiment, the system according to the first aspect of the invention further comprises a filter which is configured to filter the gaseous mixture. In the particular embodiment, the dehumidification system is connected to the textile processing machine via the aforementioned filter. Therefore, in the particular embodiment the dehumidification system receives, via the filter, the gaseous mixture from the textile processing machine. Preferably the filter is a strainer filter or another type of mechanical filter. More generally, the filter preferably is configured for filtering out (i.e. removing) textile fibers or particles, such as dust, to prevent the contamination of the dehumidification system. In an embodiment, the filter is located at a gas line that connects the dehumidification system with the textile processing machine.

In a preferred embodiment, the system according to the first aspect of the invention further comprises a circulation pump which is configured to return to the textile processing machine the gaseous mixture the humidity of which is reduced by the dehumidification system during an operation of the system. Hence, in said preferred embodiment, the circulation pump takes gas from the textile processing machine, passes said gas through the dehumidification system for decreasing the moisture of the gas, and passes back to the textile processing machine the gas with the decreased (reduced) moisture.

In a preferred embodiment, the system according to the first aspect of the invention further comprises a programmable control unit which is configured to control the textile processing machine and/or the dehumidification system. More preferably, the programmable control unit is PLC-based. In an embodiment, the system comprises a control unit as described above, and further comprises an interface which is connected to the control unit. In the latter case the control unit may operationally be connected to the textile processing machine and/or the dehumidification via an electronic interface. The control unit itself may comprise such an interface. The use of the optional control unit may advantageously facilitate a highly automated use of the system of the first aspect of the invention, and in particular the execution of certain textile treatment recipes that may require accurately controlling the system.

It is known that the formation of dew, i.e. the formation of drops of water from the condensation of vapor of the gaseous mixture, depends not only on the humidity, but also on the temperature of the gaseous mixture. It is contemplated that the ozone treatment of the textiles may depend on a number of parameters such as the temperature and/or the humidity of the gaseous mixture with which the textiles are treated. Hence, it may be advantageous monitoring the temperature and/or the humidity of the gaseous mixture with which the textiles are treated within the system of the first aspect of the invention. For this purpose, in some preferred embodiments of the first aspect of the invention, the system for processing textiles further comprises one or more measurement units configured to measure the temperature and/or humidity of the gaseous mixture. These measurements units may optionally be used for providing a feedback for the operation of the dehumidification system, or for the operation of the textile treatment machine, or may optionally be used for simply monitoring the textile treatment process that is implemented using the system according to the invention. Such monitoring may be important for quality control purposes. It is noted that in a very preferred embodiment according to the first aspect of the invention, the system comprises a control unit as the one described further above, and also comprises one more measurement units. Moreover, in the aforementioned very preferred embodiment, the programmable control unit is operationally connected to the one or more measurement units, and the control unit is also configured to process temperature and/or humidity measurements made by the one or more measurement units during an operation of the system.

The present invention in a second aspect concerns a method for processing textiles, wherein the method comprises: in a machine for processing textiles, treating textiles with a gaseous mixture that comprises ozone gas; using a dehumidification system which is connected to, or is integrated into, the textile processing machine for reducing a humidity of the gaseous mixture. The machine for processing textiles can also be called textile processing machine, and may be the machine of the system of the first aspect of the invention. Also, the method of the second aspect of the invention can be implemented using the system of the first aspect of the invention.

In some preferred embodiments of the method of the second aspect of the invention, the textiles are garments, such as dyed garments, or jeans, or knits, or garments comprising denim or wool. The processing of these types of textiles at the industrial level often involves their treatment with ozone. Hence, the present invention may advantageously improve the processing of these types of garments in terms of yield, reproducibility and quality of the obtained product.

In a preferred embodiment of the method of the second aspect of the invention, the dehumidifier system reduces, i.e. lowers, the relative humidity of the gaseous atmosphere such that a condensation of the humidity in the textile processing machine is reduced or prevented. It may be understood that the dehumidifier system may reduce the gaseous mixture's relative humidity is so that the latter is or becomes less than 100%. Overall, it may be understood that most preferably the dehumidifier system is configured to control the gaseous mixture's relative humidity so that the latter is or becomes less than 100% when the dehumidifier system is in operation.

It may be understood that the method of the second aspect of the invention may optionally further comprise one or more additional textile processing steps. Some non-limiting examples of said additional steps are washing, drying, softening, abrading, processing using laser, or otherwise preparing, treating or finishing the textiles, or combinations thereof.

The present invention in another aspect concerns a textile obtained by the method of the second aspect of the invention. Hence, an aspect of the invention concerns a textile which has been treated using the method of the second aspect of the invention, or the system of the first aspect of the invention.

DETAILED DESCRIPTION

Figure 1:
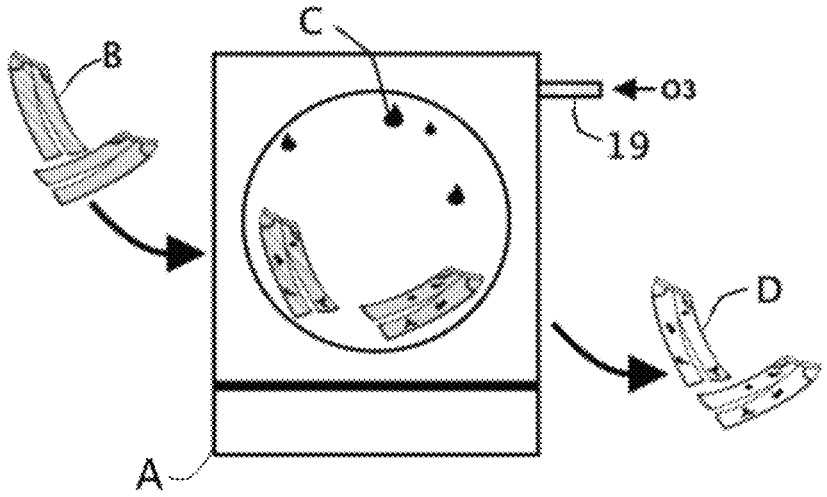
FIG. 1 (prior art)
FIG. 1 shows a representative view of the bleaching process machine in the prior art.
Figure 2:
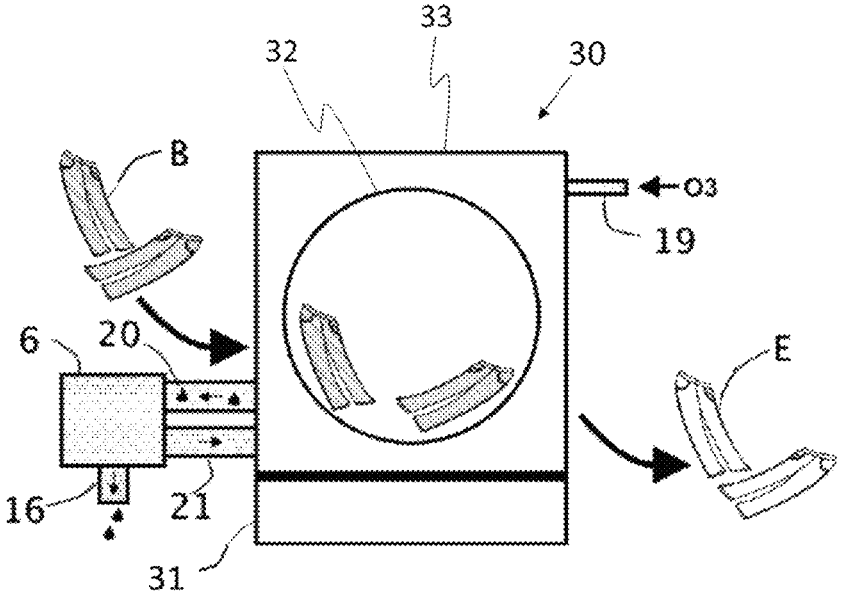
FIG. 2 shows a representative view of an embodiment of a system according to the first aspect of the invention.
Figure 3:
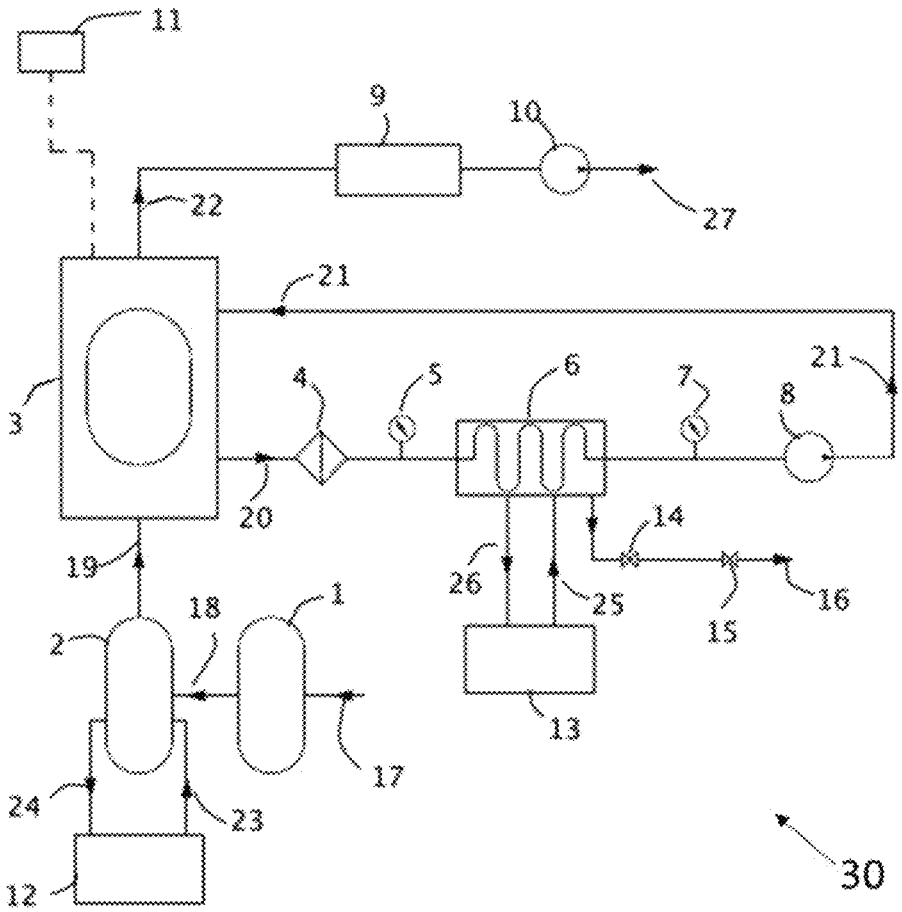
FIG. 3 shows a schematic view of an embodiment of a system according to the invention, wherein said embodiment is particularly suitable for carrying out bleaching of garments dyed with indigo, using ozone to oxidize the indigo.

With reference to FIG. 1-3, the following reference numbers and terms are used herein:

A—Bleaching Process Machine (prior art)
B—Textile and Denim Product to be Bleached
C—Droplet
D—Bleached, Stained Textile and Denim Product
E—Bleached, Stainless and Homogeneous Appearance Textile and Denim Product
1. PSA Oxygen Concentrator
2. Ozone Generator
3. Ozone Reaction Machine, textile processing machine
4. Strainer Filter
5. Machine Output Temperature and Humidity Measurement Unit
6. Dehumidification Unit
7. Dehumidification Output Temperature and Humidity Measurement Unit
8. Circulation Pump
9. Ozone Gas Catalytic Disruptor
10. Ozone Gas Discharge Pump
11. Control Unit
12. Ozone Generator Water Cooler
13. Dehumidification Cooler
14. Condensed Water First (or Upper) Drain Valve
15. Condensed Water Second (or Lower) Drain Valve
16. Condensed Water Discharge Outlet
17. Compressed Dry Air Inlet
18. Oxygen Gas Line
19. Ozone Gas Line
20. Machine High Humidity Gas Output
21. Low Humidity Gas Return After Dehumidification
22. Machine Ozone Gas Discharge Outlet
23. Ozone Generator Cold Water Inlet Line
24. Ozone Generator Heated Water Outlet Line 20
25. Dehumidification System Cold Water Inlet Line
26. Dehumidification System Heated Water Outlet Line
27. Degraded Ozone Gas (Oxygen) Discharge Outlet
30. System for processing textiles
31. Textile processing machine, machine for textile processing
32. Drum, tumbler
33. Chamber In the prior art there are known apparatuses, machines or systems which are suitable for bleaching textiles using ozone. A particular type of textiles of great interest to the industry are textiles dyed with indigo, and particularly denim garments or other types garments or textiles dyed with indigo. Ozone can be used for oxidizing the indigo dye molecules of a denim, thereby bleaching the denim, changing the color of the denim's surface. The oxidation of an indigo molecule by the latter's reaction with $O_3$ (ozone) in the presence of a water may result to the release of additional water, and hence, to the increase of the overall humidity on or around the textile.

The inventors of the present invention noticed that when bleaching jeans or other types of denims using ozone in a known textile processing machine, there are droplets of water formed in the system's space where the denims are processed. The inventors further noticed that when the aforementioned droplets are formed, very often the surface of the bleached denims have unwanted spots due to excessive bleaching in said spots, as is schematically shown in FIG. 1 which schematically shows a known textile processing machine A used for bleaching denims B, in particular jeans, which are introduced in a rotative tumbler in a chamber of the machine. As shown in FIG. 1, ozone gas ($O_3$) is introduced in said chamber via a gas inlet 19, and the bleaching of the jeans with $O_3$ results to the formation of water droplets C and the unwanted formation of over-bleached spots on the surface of the processed jeans D.

FIG. 2 shows an embodiment of a system according the present invention, and this system can avoid the formation of said spots on the processed jeans (textiles) D. With reference to FIG. 2, the shown system comprises a machine 31 for textile processing, which can also be called textile processing machine 31. The latter is configured to treat, within it, textiles using a gaseous mixture comprising ozone ($O_3$) gas. The machine 31 of FIG. 2 may be similar to the machine A of FIG. 1. The system shown in FIG. 2 also comprises a dehumidification system 6 which is connected to the textile processing machine. The dehumidification system is configured to reduce a humidity of the gaseous mixture. With reference to FIG. 2, the particular dehumidification system 6 is a dehumidifier, which can also be called dehumidification unit, that is connected to the textile processing machine 31 via appropriate tubing (gas lines), so that the dehumidifier can receive from the machine 31 a high humidity gas output via a respective output tube 20, and return to the machine 31 low humidity gas after dehumidification, via a respective return tube 21. The dehumidification system of the embodiment of FIG. 2 further comprises a discharge outlet 16 which may also be called condensed water discharge outlet and allows the discharge of liquid water that is produced from the condensation of the humidity in the dehumidifier 6. The textile processing machine 31 of the system 30 of FIG. 2, also comprises a drum 32, i.e. a tumbler, which is located in a chamber 33 of the machine 31. The ozone is introduced in the chamber 33 via the gas inlet 19, and can also enter in the drum. The drum may optionally be perforated for facilitating the flow of ozone and/or water through the same. A gaseous mixture comprising air and ozone can be formed within the chamber 33. Alternatively, the gas inlet 19 can be used for introducing in the chamber a gaseous atmosphere comprising ozone and one ore more other gases such as air, oxygen, nitrogen, water vapors, or others.

Referring to FIG. 3, the embodiment shown therein is as follows. The system 30 for textile processing shown in FIG. 3 comprises a Pressure Swing Adsorption (PSA) oxygen concentrator 1 which purifies the oxygen in the air coming from a compressed dry air inlet 17 and sends it to an ozone generator 2 via an oxygen gas line 18. The ozone generator 2 produces ozone gas which is fed into a textile processing machine 3. The textile processing machine can also be called ozone reaction machine 3 and enables the bleaching of wetted textile and denim products B. In the ozone reaction machine, the denim products B can be bleached with ozone gas and water. Hence the denim can be bleached with ozone at the presence of liquid water, water vapors or, more generally, humidity. The system 30 further comprises a strainer filter 4 that filters the gas at the high humidity gas outlet 20 via which the gaseous mixture which originally is found in the ozone reaction machine 3 and has a relatively high humidity enters a dehumidification unit 6 of the system 30. The system 30 also comprises a temperature and humidity measurement unit 5 next to said high humidity and has outlet 20 and filter 4. The temperature and humidity measurement unit 5 is configured to measure the temperature and humidity value of the gas at the high humidity gas outlet 20. With reference to FIG. 3, the dehumidification unit 6 provides dew by lowering the humidity in the air (the gaseous mixture) at the high humidity gas outlet 20 and collects water droplets which are formed as a result of dew. The system 30 of FIG. 3 also comprises a second temperature and humidity measurement unit 7 which measures the temperature and humidity of the air whose humidity is reduced in the dehumidification unit 6. It is noted, that alternatively the temperature and humidity measurement units 5,7 of the system 30 of FIG. 3 may be located at different locations of the system, and for example there may be a temperature and/or humidity measurement unit at, or close to, the textile processing machine 3 for measuring the humidity and temperature of the gaseous atmosphere within the machine 3.

The system 30 of FIG. 3 further comprises a circulation pump 8 which when it in operation ensures that the dehumidified air gaseous mixture is returned to the machine 3 through the low-humidity gas return line 21 after dehumidification. The system of FIG. 3 also comprises an ozone gas catalytic disruptor 9, i.e. an ozone gas destruction system, which converts into oxygen, the ozone gas coming from the machine 31 via a respective ozone gas discharge outlet 22. Likewise, the system of FIG. 3 comprises an ozone gas discharge pump 10 which is configured to provide oxygen gas, that is produced from the degradation of the ozone in the catalytic disruptor 9, to the environment from (via) a degraded ozone gas (oxygen) discharge outlet 27. In addition, the system 30 of FIG. 3 comprises a user interface and PLC-based control unit 11 which is programmable and is configured to electronically operate (control) the whole process (i.e. the operation of the system), and to make and/or receive the temperature and humidity measurements by being operationally connected with the temperature and humidity measurement units 5, 7. The control unit 11 may further operationally communicate and/or control the operation of different parts of system 30.

The system 30 of FIG. 3 also comprises an ozone generator water cooler 12 which is configured to cool the ozone generator 2 during ozone production by circulating, via an ozone generator cold water inlet line 23, water through the ozone generator 2. The system 30 of FIG. 3 also comprises a dehumidification cooler 13 which is used as a closed-circuit water cooler to cool a zone of the dehumidified unit 6 to cause within the latter the formation of dew (condensed water). In the embodiment of FIG. 3 there are also a condensed water first (or upper) discharge valve 14 and a condensed water second (or lower) discharge valve 15 which are configured to allow the condensed water accumulated in the dehumidification unit 6 to be discharged via the condensed water discharge outlet 16. Also, as indicated further above, the system of FIG. 3 comprises an ozone gas line 19 that is configured to provide ozone, via a corresponding inlet, to the ozone reaction machine 3. The system 30 of FIG. 3 also comprises an ozone generator heated water outlet line 24 which allows that the heated water (i.e. the water that circulated via the ozone generator water cooler 12 and the inlet line 23) is returned to the ozone generator water cooler 12. In addition, as shown in FIG. 3, in the particular embodiment the dehumidification system which comprises said dehumidification unit 6, also comprises a cold-water inlet line 25 which provides the water from the dehumidification cooler 13 to the dehumidification unit 6. Likewise, the dehumidification system also comprises a respective water outlet line 26 that returns to the dehumidification cooler 13 the heated water, i.e. the water that cools the dehumidification unit 6.

Figure 4:
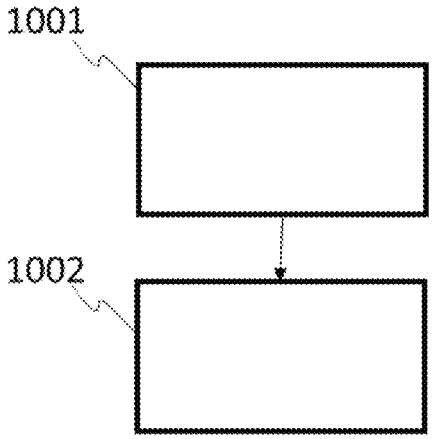
FIG. 4 shows a diagram of a method for treating textiles.

FIG. 4 shows a flow diagram of a preferred embodiment of a method according to the second aspect of the invention, and said embodiment comprises the following:

In method step 1001, treating textiles in a machine for textile processing with a gaseous mixture that comprises ozone gas;

In method step 1002, reducing a humidity of the gaseous mixture. The step 1002 can be executed using a dehumidification system which is connected to, or is integrated into, the textile processing machine.

A preferred embodiment of the aforementioned method is implemented using the system of FIG. 2. Another embodiment of the method is implemented by operating the system of FIG. 3.

An operation of the system of FIG. 3 for implementing an embodiment of the method according to the invention is as follows. Wetted textile and denim product B (shown in FIG. 2) to be bleached, said product B exhibiting a substantially high humidity, and for example has a wet pickup value in the range of 20-150%, is placed in the ozone reaction machine 3 which, as mentioned further above, can also be called textile processing machine. Then, ozone gas is supplied to the ozone reaction machine 3 via the latter's gas line 19 entrance. While the ozone gas is being supplied, the high humidity of the gaseous atmosphere with the ozone inside the machine 3 is reduced by the dehumidification unit 6 inside which there accumulates liquid water from the dew formed. The dehumidified air (gaseous mixture) is given back to the ozone reaction machine 3 via the low humidity gas return 21 after dehumidification. This way it is achieved that dew and dripping do not occur inside the ozone reaction machine 3. Over time, the relative humidity inside the ozone reaction machine 3 does not rise above 100%. The textile and denim product to be bleached B in the ozone reaction machine 3 is bleached homogeneously, and staining does not occur. Thus, the desired bleached and homogeneous appearance textile and denim product E (shown in FIG. 2) emerges. In another embodiment which is similar to the previous one, the product B is introduced in the machine 3 together with another wet material e.g. together with wet cloths or towels. In other embodiments, the product B being wet or dry is introduced in the machine 3 wherein water is also provided in a liquid, vapor (gas) or spray form.

The system 30 of FIG. 3 can perform a bleaching process of textile and denim products by using ozone and water. Further aspects of the operation of the system 30 of FIG. 3 are as follows. The system's PSA oxygen concentrator 1 purifies the oxygen in the air coming from the compressed dry air inlet 17 and sends it to the ozone generator 2 via the oxygen gas line 18. The ozone generator 2 produces ozone from oxygen. During the ozone production, the ozone generator 2 needs to be cooled. The ozone generator water cooler 12 provides the cooling process.

Said ozone generator water cooler 12 is a closed-circuit water-cooling system. Cooling is provided by circulating the cold water produced in the ozone generator water cooler 12 through the ozone generator 2 via the ozone generator cold water inlet line 23. The generated heated water is returned to the ozone generator water cooler 12 via the ozone generator heated water outlet line 24. The ozone gas produced in the ozone generator 2 is sent to the ozone reaction machine 3 via the ozone gas line 19. In the ozone reaction machine 3, indigo and reactive dyestuffs on high humidity and wet textiles and denim products may react chemically with ozone gas which, hence, bleaches the textiles by making the latter's colors. As a result of this chemical reaction, large amounts of water molecules may be formed. The inventors noticed that if the relative humidity of the environment rises above 100%, dew and dripping occur and cause staining on textile and denim products. In order to prevent this, the gas at the high humidity gas outlet 20 from the interior of the ozone reaction machine 3 is first passed through a strainer filter 4, and then the temperature and humidity are measured by the machine outlet temperature and humidity measurement unit 5. Humidity is reduced in the gaseous mixture passing through dehumidification unit 6, as a result of the formation of dew. Hence, water droplets are formed as a result of dew accumulated in the dehumidification unit 6. The accumulated condensed water is discharged from the condensed water discharge outlet 16 through the two valves 14, 15 which are the condensed water upper discharge valve 14 and the condensed water lower discharge valve 15.

The temperature and humidity of the air whose humidity is reduced in the dehumidification unit 6 are measured again in the dehumidification output 20 temperature and humidity measurement unit 7. After dehumidification, the ozone (the gaseous mixture comprising the ozone) is returned to the ozone reaction machine 3 via the low humidity gas return 21 and the circulation pump 8.

Regarding the operation of the embodiment of FIG. 3, a low temperature is required in order to form dew in the dehumidifier 6. Typically, this low temperature is 2-3 degrees slightly above freezing point. A dehumidification cooler 13 is used to maintain this temperature. Said dehumidification cooler 13 is a closed-circuit water cooler. The water that is cooled by the dehumidification cooler 13 is circulated in the dehumidification system through the dehumidification system cold water inlet line 25. The heated water is returned to the dehumidification cooler 13 via the dehumidification system heated water outlet line 26.

Also, regarding the operation of the embodiment of FIG. 3, while being evacuated, the ozone gas coming from the ozone gas discharge outlet 22 of the machine is converted to oxygen by the ozone gas catalytic disruptor 9 and the degraded ozone gas (oxygen) is given to the environment as degraded ozone gas (oxygen) via the ozone gas discharge pump 10 and the discharge outlet 27. Moreover, regarding the embodiment of FIG. 3, it is the control unit 11 (HMI+PLC) that based on one or more programs it carries, it may operate electronically the whole process and make temperature and humidity measurements.

In view of the present invention, the inventors propose the following for explaining why there are spots in textile and denims processed with machines known in the prior art. With reference to FIG. 1, in said known machines of the prior art, the textile and denim product B to be bleached B is put into the ozone reaction machine A. Then, ozone gas is supplied from the ozone gas line 19 entrance of the ozone reaction machine 30. When the relative humidity in the ozone reaction machine exceeds 100% over time, the dew and water droplets C occur. The water droplets C adhere to the textile and denim product to be bleached B, causing some places/spots to become more wet. Since in that case the humidification of the textiles is not homogeneous, the colors of the places where water droplets C contact the textile react with ozone gas at different rates, causing the occurrence of an inhomogeneous bleaching and related staining of the textile. Hence, stained textile and denim products D are formed.

While preferred embodiments of the present invention concern the processing of textiles dyed with indigo, the present invention may also be used for the processing of textiles dyed with different dyes, or not dyed at all. Moreover, the method according to the present invention, may also comprise one more additional steps to the ones described further above. Non-limiting examples of such additional steps are wetting, drying, dyeing, washing, abrading, bleaching, wetting the textiles or otherwise preparing, processing or finishing the textiles.

While the foregoing is directed to embodiments of the present invention, other and further embodiments of the invention may be devised without departing from the basic scope thereof.

The invention claimed is:

1. A system comprising:

a machine for processing textiles and configured to treat, within the same a chamber disposed within the machine, textiles with a gaseous mixture comprising ozone gas;

an ozone generator configured to produce the ozone gas for the gaseous mixture based on air from a source external to the machine, and to provide the ozone gas to the chamber;

a dehumidification system connected to, or integrated into, the machine and configured to reduce a humidity of the gaseous mixture within the chamber; and a circulation pump configured to take gaseous mixture from the chamber, to pass said gaseous mixture through the dehumidification system for decreasing the humidity of the gaseous mixture, and to return to the chamber the gaseous mixture the humidity of which is reduced by the dehumidification system during an operation of the system.

2. The system according to claim 1, wherein the dehumidification system comprises at least one of a dehumidifier compressor, a condenser, a desiccant dehumidifier, and a membrane-based dehumidifier.

3. The system according to claim 1, wherein the machine comprises a drum in the chamber, the drum configured to receive the textiles to be processed.

4. The system according to claim 1, wherein the dehumidification system comprises a closed-circuit cooler configured to cool a zone via which the gaseous mixture passes in the dehumidification system, so that dew is produced in said zone.

5. The system according to claim 1, wherein the dehumidification system comprises a condenser and a water discharge line which comprises a discharge outlet and a gas anti-leakage system configured to discharge via the same water formed by dew formed at the condenser when the system is in operation, and the gas anti-leakage system is also configured to prevent ozone from escaping to the environment via the water discharge line when the system is in operation, the gas anti-leakage system comprising a syphon, and/or two water discharge valves which are sequentially located along the water discharge line.

6. The system according to claim 1, further comprising a filter via which the dehumidification system is connected to, and can receive the gaseous mixture from, the chamber, wherein the filter is configured to filter the gaseous mixture, the filter being a strainer filter.

7. The system according to claim 1, further comprising one or more measurement units configured to measure the temperature and/or humidity of the gaseous mixture.

8. The system according to claim 1, further comprising a programmable control unit and an interface connected to the control unit, the interface configured to control the machine and/or the dehumidification system, the programmable control unit is PLC-based.

9. The system according to claim 8, further comprising one or more measurement units configured to measure the temperature and/or humidity of the gaseous mixture;

wherein the programmable control unit is operationally connected to the one or more measurement units and configured to process measurements made by the one or more measurement units during an operation of the system.

10. A method for processing textiles, comprising operating the system of claim 1 by:

Treating textiles, in the machine for processing textiles, with a gaseous mixture that comprises ozone gas; and using the dehumidification system for reducing a humidity of the gaseous mixture.

11. The method according to claim 10, wherein the textiles are garments, and the garments comprise at least one of dyed garments, jeans, knits, or garments comprising denim or wool.

12. The method according to claim 10, wherein the dehumidification system reduces the relative humidity of the gaseous mixture so that a condensation of the humidity in the textile processing machine is reduced or prevented.

13. The method according to claim 10, further comprising one or more additional textile processing steps.

14. The system according to claim 1, wherein the source external to the machine comprises a dry air inlet, and the system further comprises an oxygen concentrator configured to provide oxygen, obtained from air received via the dry air inlet, to the ozone generator for producing the ozone gas.

* * * * *